United States Patent [19]

Munekata et al.

[11] 4,391,066

[45] Jul. 5, 1983

[54] GRINDING MACHINE WITH DETECTION DEVICE FOR USEABLE LIMIT OR GRINDING WHEEL

[75] Inventors: Kenichi Munekata; Kunihiko Unno, both of Kariya; Norihiko Shimizu, Nagoya, all of Japan

[73] Assignee: Toyoda Koki Kabushiki Kaisha, Kariya, Japan

[21] Appl. No.: 273,580

[22] Filed: Jun. 15, 1981

[30] Foreign Application Priority Data

Jun. 18, 1980 [JP] Japan ..... 55-82447

[51] Int. Cl.[3] ..... B24B 49/18

[52] U.S. Cl. ..... 51/165.87; 125/11 CD

[58] Field of Search ..... 51/165.77, 165.87, 165.88, 51/165.71; 125/11 R, 11 CD

[56] References Cited

U.S. PATENT DOCUMENTS 3,760,539 9/1973 Robillard ..... 51/165.88
4,053,289 10/1977 Tatsumi ..... 51/165.88
4,122,635 10/1978 Asano ..... 51/165.71
4,266,374 5/1981 Asano et al. .

FOREIGN PATENT DOCUMENTS 48-19197 5/1973 Japan .

*Primary Examiner*—Harold D. Whitehead
*Attorney, Agent, or Firm*—Oblon, Fisher, Spivak, McClelland & Maier

[57] ABSTRACT

A device for detecting grinding wheel life is provided including a truing tool wear detection device for detecting a total wear amount of a truing tool after every truing operation and an arithmetic and judgement circuit arrangement. The circuit arrangement compensates for the total wear amount by a theoretic in-feed amount through which the truing tool has to have been in-fed from its original position when the grinding wheel is worn down to a predetermined limit. Further, the circuit arrangement calculates an actual in-feed amount of the truing tool and by comparing the actual in-feed amount with the compensated theoretical in-feed amount, judges whether or not the grinding wheel has been worn down to a predetermined limit.

13 Claims, 17 Drawing Figures

GRINDING MACHINE WITH DETECTION DEVICE FOR USEABLE LIMIT OR GRINDING WHEEL

BACKGROUND OF THE INVENTION

1. Field of the Invention

The present invention relates to a grinding machine having a device for detecting the state of wear of a grinding wheel and more particularly to a grinding machine having a device for determining whether the grinding wheel has been worn down beyond the limit of use.

2. Description of the Prior Art

Generally, in a production-type grinding machine with an automatic dressing or truing apparatus, a truing tool is slidably guided toward the axis of a grinding wheel. At the time of the truing operation, the grinding surface of the grinding wheel is trued by in-feeding the truing tool against the grinding wheel by a preselected in-feed amount. The grinding machine ordinarily incorporates a detection device which determines whether the grinding wheel has been worn down to the limit of use by detecting the advancement of the truing tool to a predetermined position by means of a dog and a limit switch actuated thereby.

Even using such a prior art detection device, unless the truing tool suffers wear, the wear status of the grinding wheel down to a limit of use can be exactly detected only by adjusting the space between the dog and the limit switch to the thickness of an abrasive layer of the grinding wheel. However, not only does the truing tool actually suffer wear, but such wear of the truing tool is also difficult to predict. Accordingly, it is impossible to set the relative position between the dog and the limit switch accurately while taking into account the prospective wear of the truing tool. Thus the prior art detection device is not able to exactly detect the wear status of the grinding tool down to the limit of use.

SUMMARY OF THE INVENTION

Accordingly, it is a primary object of the present invention to provide an improved grinding machine having a detection device capable of exactly detecting whether a grinding wheel has been worn down to a predetermined useable limit independently of the wear of a truing tool.

Another object of the present invention is to provide an improved machine having a detection device of the type set forth above which is particularly useful when applied to a grinding machine having a cubic boron nitride (CBN) or diamond grinding wheel.

Briefly, according to the present invention, these and other objects are achieved by the provision of a grinding machine having a grinding wheel limit detection device which comprises a truing tool wear detection device for detecting a total wear amount of a truing tool after every truing operation. The detection device further comprises an arithmetic and judgement circuit which is coupled to the truing tool wear detection device. This circuit is designed to take the total wear amount of the truing tool into consideration when judging whether or not the grinding wheel has been worn down to a predetermined size limit. Thus, it is possible to exactly detect whether the grinding wheel has been worn down to the predetermined size limit independently of the wear of the truing tool. Further, the grinding wheel limit detection device is particularly useful when applied to a grinding machine with a cubic boron nitride (CBN) or diamond grinding wheel since it has an exact detection capability.

In one preferred embodiment of the present invention, a calculation is made of theoretical in-feed amount through which the truing tool has to have been in-fed from its original position when the grinding wheel is worn down to the predetermined size limit. The theoretical in-feed amount is compensated by the total wear amount of the truing tool. This compensated theoretical in-feed amount is compared with an actual in-feed amount of the truing tool from the original position, so that it can be exactly judged whether or not the grinding wheel has been worn down to the predetermined size limit.

In another preferred embodiment of the present invention, a theoretical grinding wheel size is repeatedly calculated by subtracting a predetermined truing in-feed amount from a previously calculated theoretical grinding wheel size at the time of each truing operation. The theoretical grinding wheel size is then compensated by the total wear amount of the truing tool. The compensated theoretical grinding wheel size, that is, an actual grinding wheel size is then compared with the predetermined size limit of the grinding wheel to exactly determine whether or not the grinding wheel has been worn to the predetermined size limit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
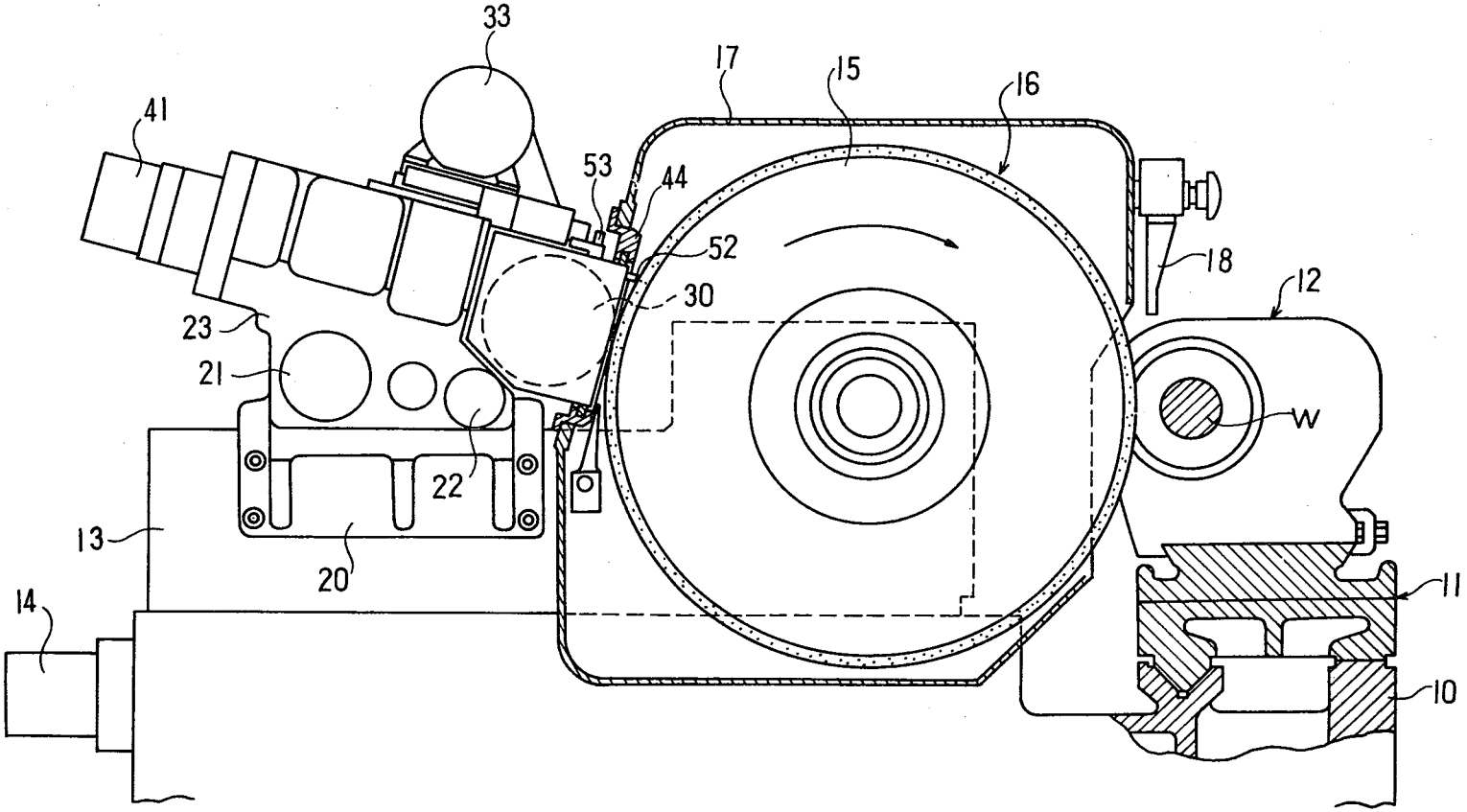
FIG. 1 is a side elevation view, partly in section, of a grinding machine with a grinding wheel limit detection device according to the present invention.

Referring now to the drawings, wherein like reference numerals or characters refer to identical or corresponding parts throughout the several views, and more particularly to FIG. 1, there is shown a bed 10 of a grinding machine, on which a table 11 is slidably mounted. A workpiece support device 12 is mounted on the table 11 for rotatably supporting a workpiece W to be ground. A wheel support 13 is also mounted on the bed 10 to be movable toward and away from the workpiece W. Feed movement of the wheel support 13 is controlled by a servomotor 14 secured to the bed 10 through a well known thread mechanism. A grinding wheel 16 is mounted on the wheel support 13 to be rotatable about an axis perpendicular to the movement of the wheel support 13. The grinding wheel 16 is of such configuration that abrasive grain, made of a hard material, such as cubic boron nitride, is press-formed and bonded on the outer peripheral surface of a base ring 15 made of aluminum. This grinding wheel 16 is rotated in the direction of the arrow by a wheel drive motor, not shown, mounted on the wheel support 13. A wheel cover 17 is secured to the side face of the wheel support 13 for covering the grinding wheel 16. A coolant nozzle 18 is secured to the front portion of the wheel cover 17 for supplying cooling fluid during a grinding operation on the workpiece W.

Figure 2:
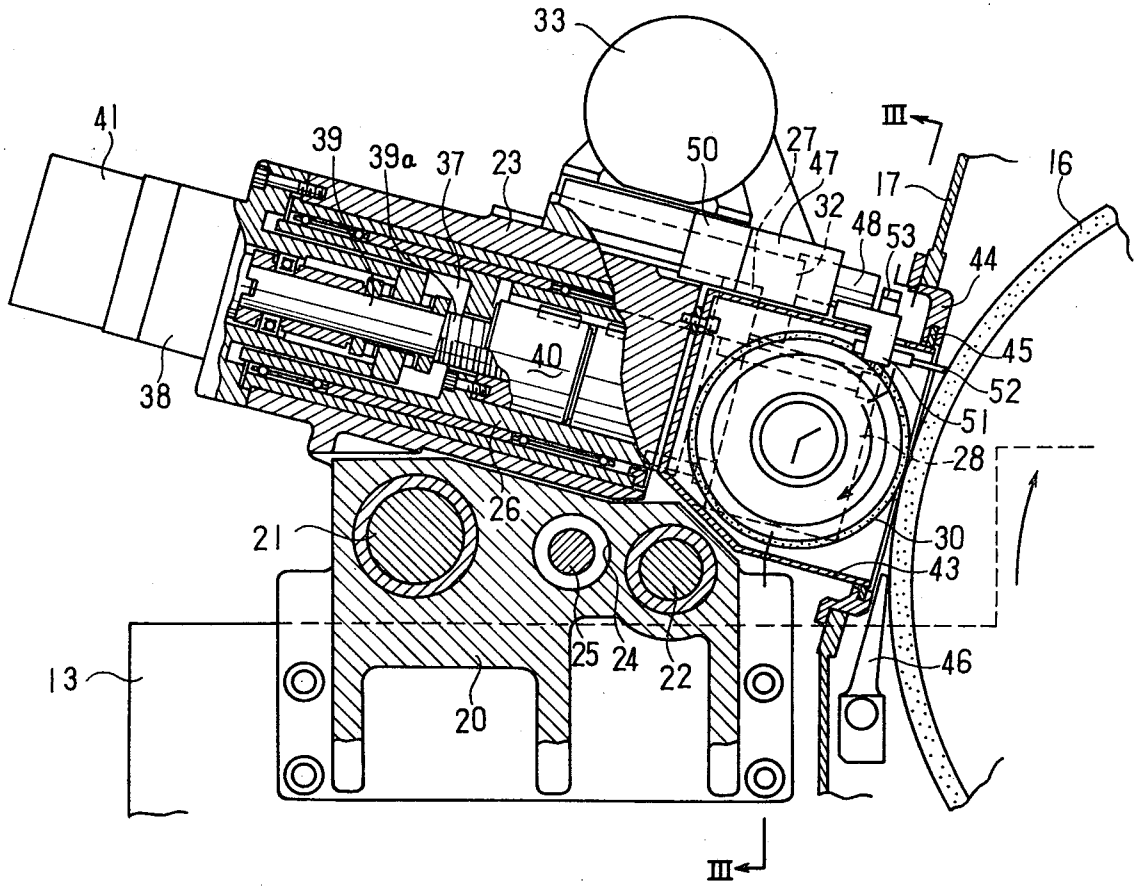
FIG. 2 is a fragmentary enlarged sectional view of a truing device provided on the grinding machine.
Figure 3:
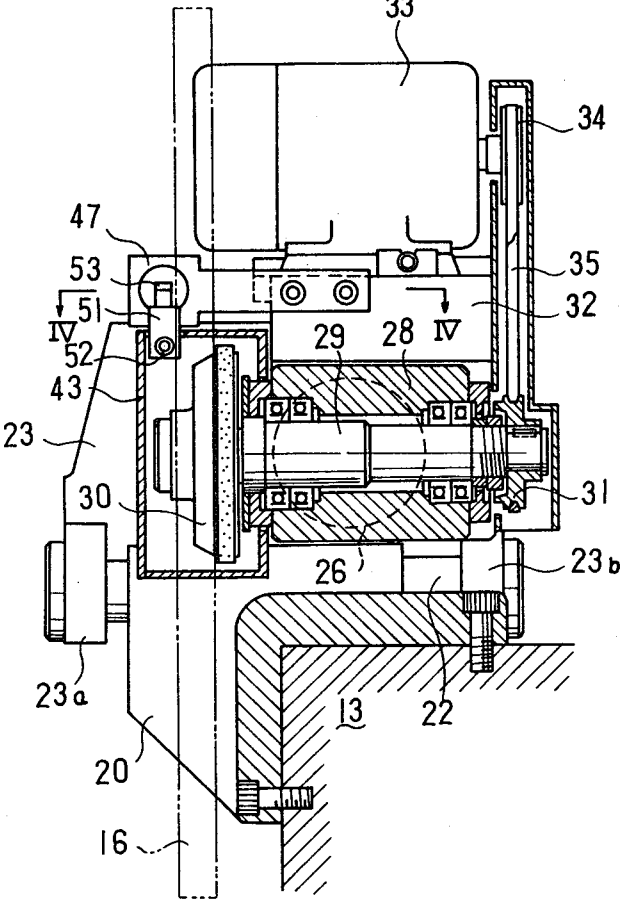
FIG. 3 is a sectional view taken along the line III—III in FIG. 2.

Referring to FIGS. 2 and 3, a support base 20 is mounted on the wheel support 13 rearwardly of the grinding wheel 16. A pair of parallel pilot bars 21 and 22 are received within the support base 20 to be slidable in a horizontal direction parallel to the grinding surface of the grinding wheel 16. End legs **23*a* and 23*b* of a traverse carriage 23 are securedly supported on opposite ends of the pilot bars 21 and 22 projected from the support base 20. The support base 20 is formed with a traverse cylinder 24 within which a piston, not shown, is received to be slidable in a direction parallel to the axes of the pilot bars 21 and 22. A piston rod 25 of the piston is secured to the leg 23*a* of the traverse carriage 23, so that the traverse carriage 23 is traversed a predetermined stroke by the actuation of the traverse cylinder 24**.

An in-feed ram 26 is received in the traverse carriage 23 to be slidable in a direction inclined downwardly toward the center of the grinding wheel 16. The ram 26 has fixed at its one end a plate 27 to which is connected a pilot bar, not shown, slidably received in the traverse carriage 23 for movement in a direction parallel to the axis of the ram 26 to prevent rotation of the ram 26. A truing head 28 is secured to the plate 27 and rotatably carries a support shaft 29 for rotation about an axis parallel to the grinding surface of the grinding wheel 16. A truing wheel 30 is secured to one end of the support shaft 29 and enters within the wheel cover 17 through the opening formed at the rear portion of the wheel cover 17. The truing wheel 30 is such that an abrasive grain of diamond is bonded on the outer periphery of a metal-made base ring and is designed to have its width less than that of the grinding wheel 16 in order to decrease resistance occurring in the truing operation. The support shaft 29 has secured to its other end a pulley 31 which is connected through belts 35 to a pulley 34 secured to an output shaft of a drive motor 33. The motor 33 is mounted on a slide base 32 which is slidably and adjustably mounted on the traverse carriage 23 for movement in a direction parallel to the axis of the in-feed ram 26. The slide base 32 is also connected to the plate 27 for adjustment of its position. The truing wheel 30 is rotated by the motor 33 in the same direction as that of the grinding wheel 16 to perform an up-cut truing operation on the grinding wheel 16.

An in-feed apparatus 37 is provided for in-feeding the truing head 28 secured to the in-feed ram 26 toward the grinding wheel 16. The in-feed apparatus 37 comprises an in-feed box 38 which is secured to the rear end of the traverse carriage 23 and which supports an in-feed shaft 39 rotatable about an axis coaxial with that of the in-feed ram 26. The in-feed shaft 39 is formed at its front end with a threaded portion **39*a* which is in threaded engagement with a nut 40 secured within the in-feed ram 26. The rear end of the in-feed shaft 39 is connected to a servo-motor 41 through a suitable reduction gearing received in the in-feed box 38**.

A cover 43, formed in a rectangular shape in cross-section, is secured to the front end of the traverse carriage 23 to cover the truing wheel 30. A guide frame 44 is fitted into the rear opening of the wheel cover 17 and slidably receives a slide cover 45 for movement in the traversing direction of the traverse carriage 23. The slide cover 45 is formed with a rectangular opening to receive the cover 43. Numeral 46 denotes a coolant nozzle to supply coolant between the truing wheel 30 and the grinding wheel 16.

Figure 4:
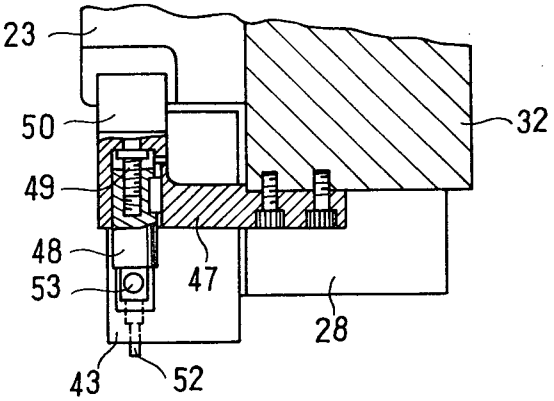
FIG. 4 is a sectional view taken along the line IV—IV in FIG. 3.

As shown in FIG. 4, a support bracket 47 is secured to the front end of the slide 32. An in-feed shaft 48 is received in the support bracket 47 to be slidable in a direction parallel to the sliding direction of the in-feed ram 26, but is restrained from rotation relative to the support bracket 47. A feed screw shaft 49, which is in threaded engagement with the in-feed shaft 48, is rotatably supported by the support bracket 47 and is connected to a hydraulic feed device 50, containing a ratchet mechanism therein, to be rotated a predetermined amount. A block 51 having an L-shaped configuration is connected at its one end to the front end of the in-feed shaft 48. The other end of the block 51 enters within the cover 43 through the opening formed in the cover 43. A touch sensing or contact detection bar 52 is detachably secured to the other end of the block 51 in a parallel relationship with the in-feed shaft 48. The front end of the detection bar 52 opposes the outer peripheral surface of the grinding wheel 16. A vibration detector 53 is mounted on the block 51 outside the cover 43 for detecting vibrations caused by the contact between the detection bar 52 and the grinding wheel 16. The detection bar 52 is spaced from the truing wheel 30 in an axial direction of the grinding wheel 16 by a predetermined distance which is longer than the width of the grinding wheel 16.

Figure 5:
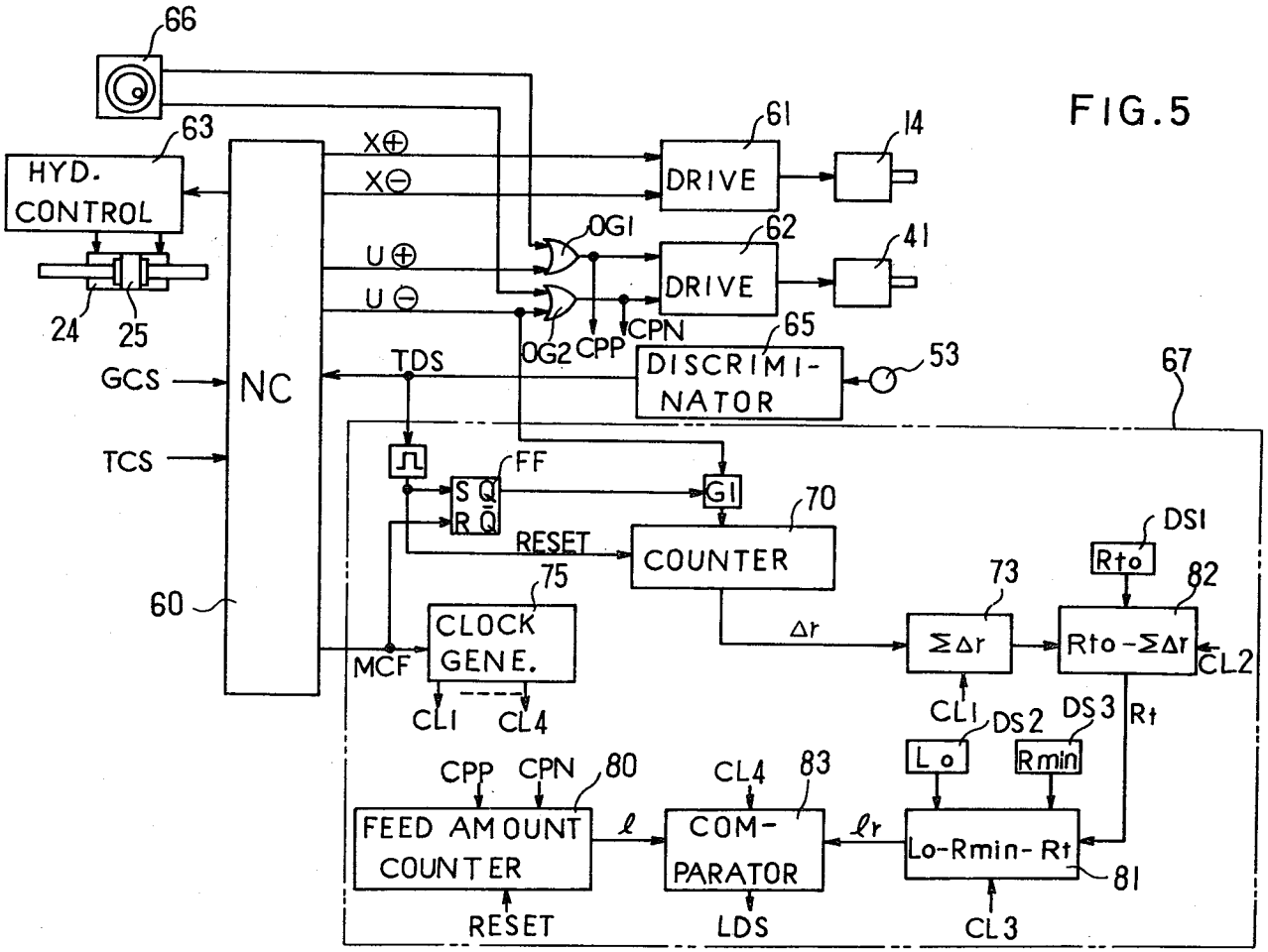
FIG. 5 is a block diagram showing a control circuit for a grinding wheel support and a truing wheel support head as well as a detection circuit for detecting whether the grinding wheel has been worn down to a predetermined size limit.
Figure 6A:
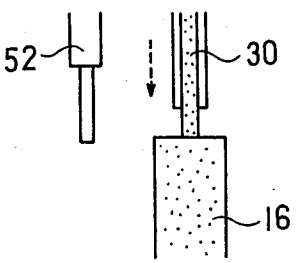
FIG. 6 is an explanatory view indicative of the positional relationship between the grinding wheel and a truing wheel in a truing operation cycle.
Figure 6B:
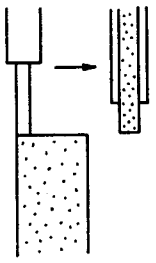
Figure 6C:
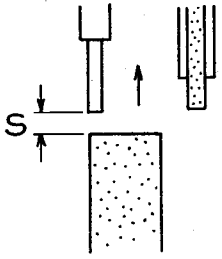
Figure 6D:
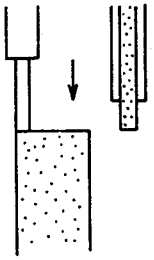
Figure 6E:
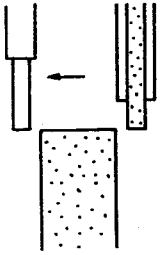
Figure 6F:
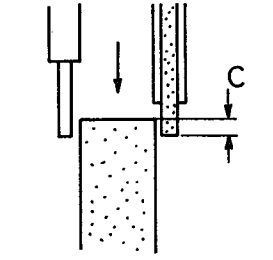
Figure 6G:
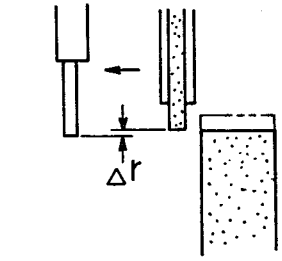
Figure 6H:
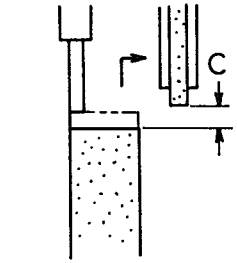
Figure 6I:
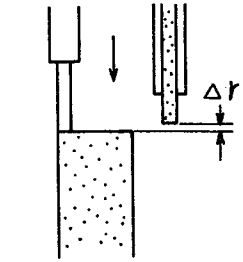
Figure 6J:
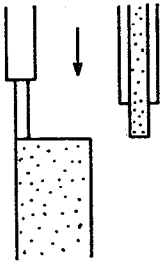

Referring now to FIG. 5 illustrative of a control circuit for controlling truing operations on the grinding wheel 16, there are provided a numerical controller 60, drive circuits 61 and 62 for respectively driving servomotons 14 and 41, and a hydraulic control circuit 63 for controlling the supply of pressurized fluid to the traverse cylinder 24. The numerical controller 60, when given a grinding instruction signal GCS, distributes pulses to the drive circuit 61 to control the feed movement of the wheel support 13. Further, the numerical controller 60, when given a truing instruction signal TCS, delivers negative-going feed pulses ⊖ to the drive circuit 62 to in-feed the truing wheel 30 against the grinding wheel 16 a predetermined truing in-feed amount from the position where the detection bar 52 comes into contact with the grinding wheel 16. The numerical controller 60, after the delivery of such negative-going feed pulses to the drive circuit 62, applies a traverse instruction to the hydraulic control circuit 63 to move the truing wheel 30 across the grinding wheel 16. The hydraulic control circuit 63 is responsive to instruction signals from the numerical controller 60 and a manual control circuit (not shown) so as to position the piston 25 to four positions where the detection bar 52 and the truing wheel 30 stand as shown in (a), (b), (e) and (g) of FIG. 6.

Still in FIG. 5, a discrimination circuit 65 detects the contact of the detection bar 52 with the grinding wheel 16 by responding to a change in the level of a signal from the vibration detector 53 secured to the detection bar 52. The discrimination circuit 65 outputs a touch sensing or contact signal TDS to the numerical controller during contact of the detection bar 52 with the grinding wheel 16. Also connected to the numerical controller 60 is a useable limit detection circuit 67 for detecting when the grinding wheel 16 has been worn down to a predetermined limit of use. This circuit 67 detects a wear amount $\Delta r$ for each truing operation of the truing wheel 30 by means of a circuit which is composed of a counter 70, a gate G1, and a flip-flop circuit FF. An accumulation circuit 73 accumulates the detected wear amount $\Delta r$ for each truing operation so that a total wear amount $\Sigma\Delta r$ of the truing wheel 30 can be determined. The circuit that is constructed by a feed amount counter 80, arithmetic circuits 81 and 82, and a comparator 83 is for detecting the wear state of the grinding wheel 16 down to its limit of use based upon the position that the truing wheel 30 occupies, when at its in-feed advanced end. This circuit compensates for the detected wear amount of the grinding wheel 16 for the total wear amount $\Sigma\Delta r$ of the truing wheel 30, so that exact detection of the wear state of the grinding wheel 16 down to its limit of use can be achieved.

Figure 7:
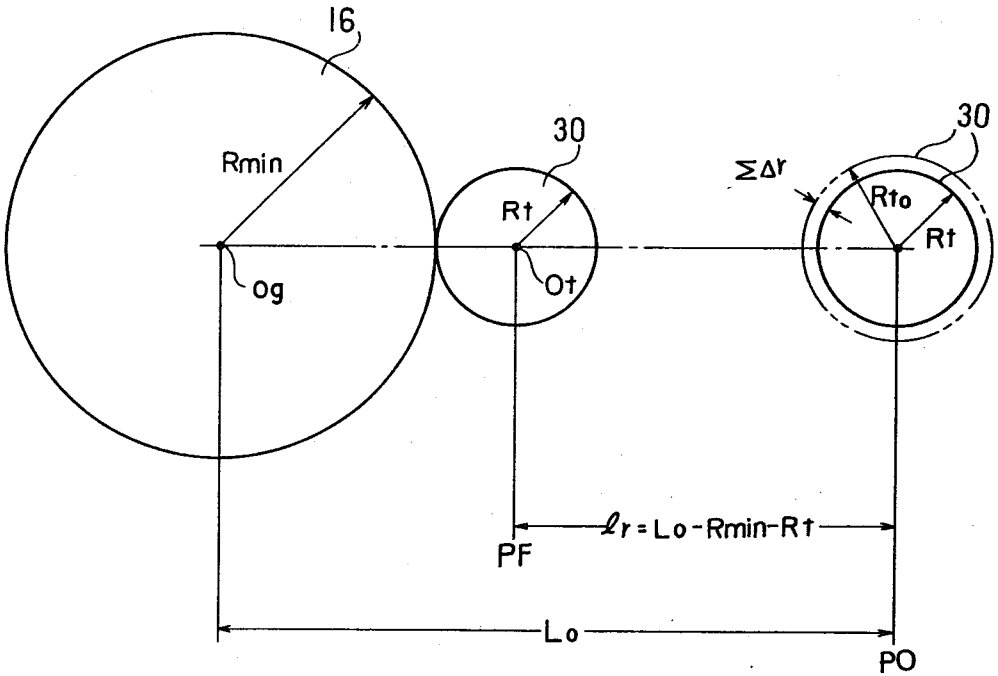
FIG. 7 is another explanatory view indicative of the in-feed end position of the truing wheel when the grinding wheel has been worn down to the predetermined size limit.

Assuming that as shown in FIG. 7, the distance between the axes of the truing wheel 30 and the grinding wheel 16 when the truing wheel 30 is at its original position Po is Lo, and further that the useable minimum radius of the grinding wheel 16 and the actual radius of the truing wheel 30 are Rmin and Rt respectively, the following expression (1) can be used to calculate a theoretical in-feed amount lr through which the truing wheel 30 has to have been displaced from its original position Po when the size of the grinding wheel 16 is decreased to the minimum radius Rmin.

$$lr = Lo - Rmin - Rt \quad (1)$$

Consequently, the wear state of the grinding wheel 16 down to its limit of use can be detected when an actual in-feed amount l of the truing wheel 30 from the original position Po coincides with the theoretical in-feed amount lr.

In this particular embodiment, the actual radius Rt of the truing wheel 30 is obtained by subtracting the total wear amount $\Sigma\Delta r$ from an initial radius Rto. of the truing wheel 30, and the theoretical in-feed amount lr is calculated as a reference in-feed amount based upon the actual radius Rt of the truing wheel 30. The arithmetic circuits 82 and 81 respectively calculate the actual radius Rt and the theoretical in-feed amount lr, and the feed amount counter 80 detects the actual in-feed amount l of the truing tool 30 from the original position Po. Digital switches DS1, DS2, and DS3 are further provided for respectively setting the above-noted data Rto, Lo, and Rmin.

The operation of the apparatus as constructed above will be described hereinafter. Upon completion of a grinding wheel exchange, the truing wheel 30 is retracted to its original position Po, and the feed amount counter 80 is reset to zero (0). The hydraulic in-feed device 50 is actuated to extend the detection bar 52 toward the axis of the grinding wheel 16 beyond the truing surface of the truing wheel 30. The subsequent operation is performed with the hydraulic control circuit 63 which controls the traverse cylinder 24 to bring the truing wheel 30 into radial alignment with the grinding wheel 16. The manually operated pulse generator 66 is operated to advance the ram 26 until the truing wheel 30 comes into contact with the grinding wheel (16 FIG. 6(*a*)). Thereafter, a rightward traverse feed movement of the traverse carriage 23 is carried out, which results in a grinding of the tip of the contact detection bar 52, whereby the truing surface of the truing wheel 30 and the tip of the detection bar 52 are lined up on a surface including the grinding surface of the grinding wheel 16 (FIG. 6(*b*)).

Subsequently, the ram 26 is retracted so that the contact detection bar 52 is spaced a preselected distance from the grinding surface of the grinding wheel 16 as shown in FIG. 6 (*c*). An intial setting operation of the truing wheel position relative to the grinding wheel 16 is thus completed, whereafter the application of a truing instruction signal TCS to the numerical controller 60 is carried out as required.

The numerical controller 60, when receiving the truing instruction signal TCS, distributes negative-going feed pulses ⊖ to the drive circuit 62 until the discrimination circuit 65 outputs the contact detection signal TDS as a result of the contact of the detection bar 52 with the grinding wheel 15 (FIG. 6 (*d*)). The controller 60 then applies a control signal to the hydraulic control circuit 63 to effect a leftward movement of the traverse carriage 23 until the movement of the detection bar 52 and the truing wheel 30 relatively brings the grinding wheel 16 therebetween (FIG. 6 (*e*)). The controller 60 further supplies to the drive circuit 62 negative-going feed pulses ⊖ of the number corresponding to a preselected in-feed amount C, thereby in-feeding the truing wheel 30 toward the grinding wheel 16 a distance equal to the in-feed amount C as shown in FIG. 6 (*f*). A control signal from the numerical controller 60 is further applied to the hydraulic control circuit 63, to cause leftward movement of the traverse carriage 23, whereby the grinding wheel 16 is trued with the truing wheel 30 as indicated in FIG. 6 (*g*). In the course of this truing operation, the truing wheel 30 suffers gradual wear. Accordingly, the grinding wheel 16 is trued at a right end portion of its grinding surface by an amount equal to the in-feed amount C, however, it is trued at a left end portion of of its grinding surface by an amount that is less, by the wear amount of the truing wheel 30, than the in-feed amount C. In this particular embodiment, a wear amount $\Delta r$ for each truing operation of the truing wheel 30 is detected by calculating the difference between a decrease in the radius at the left end portion of the grinding wheel 16 and the preselected in-feed amount C as described below.

Following this, the numerical controller 60 executes an inspection operation cycle, wherein it distributes positive-going feed pulses to the drive circuit 62 to retract the ram 26 a distance equal to the truing in-feed amount C thereby positioning the tip of the detection bar 52 to the position which the grinding surface of the grinding wheel 16 has occupied before the foregoing truing operation. The numerical controller 60 then applies a control signal to the hydraulic control circuit 63 to cause the traverse carriage 23 to move to the position where the detection bar 52 faces the left end portion of the grinding surface of the wheel 16 (FIG. 6 (*h*)). Upon completion of this positioning operation, negative-going feed pulses whose number corresponds to the preselected truing in-feed amount C are supplied again to the drive circuit 62 so as to re-advance the detection bar 52 by a distance equal to the truing in-feed amount C. This brings the detection bar 52 into contact with the grinding surface of the grinding wheel in mid-course, whereupon the contact detection signal TDS is outputed from the discrimination circuit 65. The detection bar 52 continues such advance movement as the tip thereof is ground with the grinding wheel 16 and at the termination of such advance movement, maintains the contact of the top thereof with the grinding surface of the wheel 16.

When the contact detection signal TDS is outputed from the discrimination circuit 65, as noted above, based upon the contact of the detection bar 52 with the grinding surface of the wheel 16, the flip-flop circuit FF is set, and from this time, the negative-going feed pulses ⊖ to the drive circuit 62 are also applied to the counter 20 to be counted thereby. The numerical controller 60 outputs an inspection cycle completion signal MCF at the termination of the re-advance movement by the ram 26 through the truing in-feed amount C. This signal MCF is applied to the flip-flop circuit FF which is thus reset to close the gate G1. Consequently, the application of the negative-going feed pulses ⊖ to the counter 20 is inhibited at this time, and the data that represents the wear amount $\Delta r$ of the truing wheel 30 in the foregoing truing operation is outputed from the counter 70.

The pulse generator 75 sucessively outputs a series of control clock signals CL1 through CL4 upon receipt of the inspection cycle completion signal MCF from the numerical controller 60. Arithmetic operations for the total wear amount $\Sigma\Delta r$ of the truing wheel 30 and for judgement as to whether the grinding wheel 16 has reached its limit of use or not are carried out under the control of these control clock signals CL1 through CL4 as described below.

First the generation of the control clock signal CL1 causes the accumulation circuit 73 to calculate the total wear amount $\Sigma\Delta r$ by accepting the wear amount $\Delta r$ being outputed from the counter 70. At the subsequent generation of the control clock CL2, the arithmetic circuit 82 is operated to obtain an actual radius Rt of the truing wheel 30 by subtracting the total wear amount $\Sigma\Delta r$ from the initial radius Rto of the truing wheel 30. The control clock signal CL3, when generated subsequently, enables the arithmetic circuit 81 to operate, which takes therein the calculated actual radius Rt, the distance Lo between the truing and grinding wheel axes, and the useable minimum radius Rmin of the grinding wheel 16 so as to calculate the theoretical in-feed amount lr in accordance with the above-noted expression (1).

Further, with the control clock signal CL4 generated, the comparator 83 compares the actual in-feed amount l detected by the feed amount counter 80 with the theoretical in-feed amount lr. When the result of such comparison indicates that the actual in-feed amount l detected by the feed amount counter 80 coincides with or exceeds the theoretical in-feed amount lr, a wheel change or limit detection signal LDS is outputed from the comparator 83. This detection signal LDS is used to light an indicator lamp (not shown) thereby informing an operator that the grinding wheel 16 has worn down to its limit of use.

Figure 8:
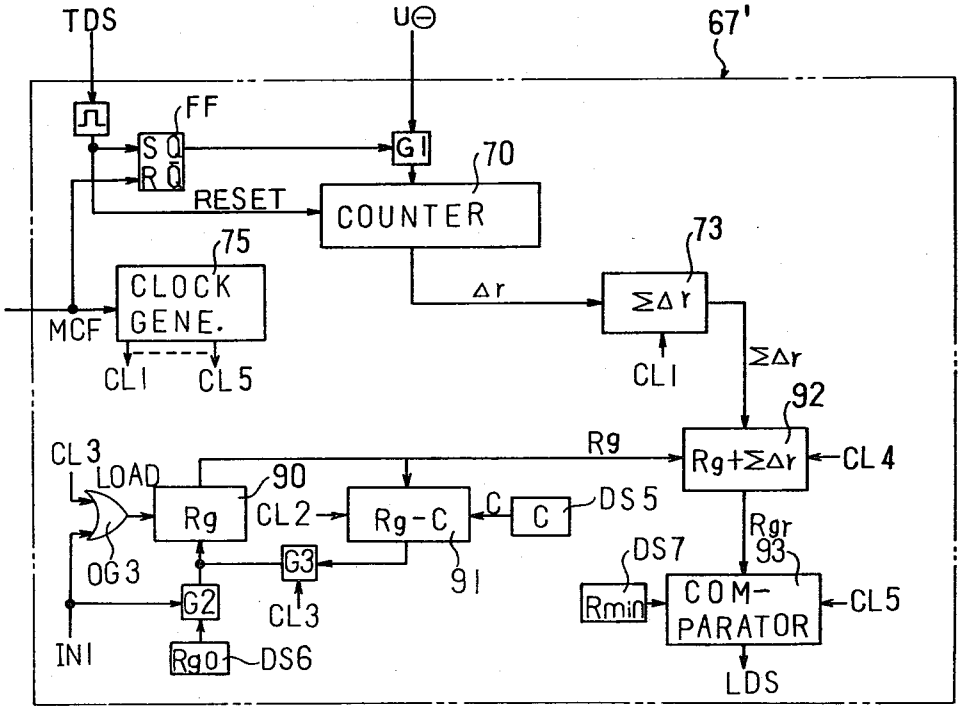
FIG. 8 is another block diagram showing another embodiment of the detection circuit shown in FIG. 5.

Referring now to FIG. 8, there is shown another embodiment of the useable limit detection circuit 67. This embodiment 67' includes a register 90 for storing a theoretical grinding wheel radius Rg, a digital switch DS6 for setting an initial grinding wheel radius Rgo, and an arithmetic circuit 91 for calculating the theoretical grinding wheel radius Rg after each truing operation by subtracting the predetermined truing in-feed amount C, being set in a digital switch DS5, from the theoretical grinding wheel radius (previously calculated theoretical grinding wheel radius) Rg which is stored in the register 90 repeatedly after each truing operation. The embodiment further includes an arithmetic circuit 92 for calculating an actual grinding wheel radius Rgr by adding the total truing wheel wear amount $\Sigma\Delta r$ to the theoretical grinding wheel radius Rg and a comparator 93 for outputting the wheel change or limit detection signal LDS when the actual grinding wheel radius Rgr coincides with or exceeds the minimum grinding wheel radius Rmin set in a digital switch DS7.

Upon completion of a grinding wheel exchange, the initial radius Rgo of a new grinding wheel 16 is set by the digital switch DS6, whereinafter a data load signal LOAD is applied to the register 90 through an OR gate OG3. This results in the initial radius Rgo of the new grinding wheel 16 being set in the register 90. Thereafter, whenever a truing operation is performed, the theoretical grinding wheel radius Rg, being stored in the register 90, is decreased by the predetermined truing period amount C for each truing operation of the truing wheel 30 under the action of the arithmetic circuit 91. When the actual grinding wheel radius Rgr, that is, the sum of the theoretical grinding wheel radius Rg and the total truing wheel wear amount $\Sigma\Delta r$ coincides with or exceeds the minimum grinding wheel radius Rmin, the limit detection signal LDS is output from the comparator 93. The operation of the useable limit detection circuit 67' is essentially similar to that of the detection circuit 67 shown in FIG. 5 and described above.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinding machine having a truing device of the type wherein a grinding wheel is trued by in-feeding a truing tool a predetermined truing in-feed amount against said grinding wheel at the time of each truing operation, comprising:

truing tool wear detection means for detecting a total wear amount $\Sigma\Delta r$ of said truing tool after each truing operation, and arithmetic and judgement means coupled to said truing tool wear detection means for receiving said total wear amount $\Sigma\Delta r$ and for judging whether or not said grinding wheel has been worn down to a predetermined size limit Rmin based upon at least said total wear amount $\Sigma\Delta r$.

2. A grinding machine as recited in claim 1, wherein said arithmetic and judgement means comprises:

truing tool position detection means for detecting an actual in-feed amount l through which said truing tool is in-fed against said grinding wheel from an original position PO, and judgement means coupled to said truing tool wear detection means and coupled to said truing tool position detection means and responsive to said total wear amount $\Sigma\Delta r$ and to said actual in-feed amount l for judging whether or not said grinding wheel has been worn down to said predetermined size limit.

3. A grinding machine as recited in claim 2, wherein said judgement means comprises:

arithmetic means coupled to receive said total wear amount $\Sigma\Delta r$ from said truing tool wear detection means for calculating, based on at least said total wear amount $\Sigma\Delta r$, a theoretical in-feed amount lr through which said truing tool has to have been in-feed from said original position PO when said grinding wheel is worn down to said predetermined limit size; and comparison means coupled to receive said actual in-feed amount l from said truing tool position detection means and coupled to receive said theoretical in-feed amount lr from said arithmetic means for producing a limit detection signal as a wheel change instruction when said actual in-feed amount l coincides with said theoretical in-feed amount lr.

4. A grinding machine as recited in claim 3, wherein said truing tool wear detection means comprises:

unit wear detection means for detecting a wear amount $\Delta r$ for each truing operation of said truing tool; and accumulation means coupled to said unit wear detection means for calculating said total wear amount $\Sigma\Delta r$ by accumulating said wear amount $\Delta r$ for each truing operation supplied thereto after each truing operation.

5. A grinding machine as recited in claim 4, wherein said arithmetic means further comprises:

first calculation means coupled to received said total wear amount $\Sigma\Delta r$ from said accumulation means and coupled to receive an initial truing tool size input Rto from a source for calculating an actual size Rt of said truing tool from said total wear amount $\Sigma\Delta r$ and from said initial truing tool size Rto; and second calculation means coupled to receive said actual size Rt of said truing tool from said first calculation means and coupled to receive said predetermined size limit Rmin of said grinding wheel and an initial distance Lo between said grinding wheel and said truing tool at said original position from a source for calculating said theoretical in-feed amount lr and for supplying said theoretical in-feed amount to said comparison means.

6. A grinding machine as recited in claim 4 or 5, wherein said unit wear detection means comprises:

touch sensing means disposed in a juxtaposed relation to said truing tool for bodily movement together therewith to and from said grinding wheel and adopted to output a touch sensing signal when brought into contact with said grinding wheel; and unit wear amount calculation means coupled to receive said touch sensing signal from said touch sensing means for calculating said wear amount $\Delta r$ for each truing operation from the difference between said predetermined truing in-feed amount and an inspection feed amount, said inspection feed amount being the amount through which said touch sensing means is fed in an inspection operation after any truing operation from an in-feed starting point until said touch sensing means outputs said touch sensing signal, said in-feed starting point being the point at which a tip of said touch sensing means and a truing surface of said truing tool are aligned with a grinding surface of said grinding wheel in advance of each truing operation and from which said truing tool is in-fed said predetermined truing in-feed amount against said grinding wheel in each truing operation.

7. A grinding machine as recited in claim 6, wherein said touch sensing means comprises:

a touch bar movable together with said truing tool to and from said grinding wheel; and vibration detector means fixed on said touch bar for generating said touch sensing signal when said touch bar is brought into contact with said grinding wheel.

8. A grinding machine as recited in claim 1, wherein said arithmetic and judgement means comprises:

first arithmetic means for calculating a theoretical grinding wheel size Rg at the time of each truing operation by subtracting a predetermined truing in-feed amount for each truing operation from a previously calculated theoretical grinding wheel size;

second arithmetic means coupled to receive said total wear amount $\Sigma\Delta r$ from said truing tool wear detection means and coupled to receive said theoretical grinding wheel size Rg from said first arithmetic means for calculating an actual grinding wheel size Rgr after each truing operation by adding said total wear amount $\Sigma\Delta r$ of said truing tool to said theoretical grinding wheel size Rg; and judgement means coupled to receive said actual grinding wheel size Rgr from said second arithmetic means for generating a wheel change signal when said actual grinding wheel size Rgr coincides with said predetermined size limit Rmin.

9. A grinding machine as recited in claim 8, wherein said first arithmetic means comprises:

register means for storing said theoretical grinding wheel size Rg;

digital switch means for setting said predetermined truing in-feed amount for each truing operation of said truing tool; and subtraction means coupled to said register means and coupled to receive said predetermined truing in-feed amount from said digital switch means for calculating said theoretical grinding wheel size Rg at the time of each truing operation by subtracting said predetermined truing in-feed amount from a previously calculated theoretical grinding wheel size Rg, said register means being adapted to repeatedly receive said theoretical grinding wheel size after the same is calculated by said subtraction means.

10. A grinding machine as recited in claim 8 or claim 9, wherein said truing tool wear detection means comprises:

unit wear detection means for detecting a wear amount $\Delta r$ for each truing operation of said truing tool after each truing operation; and accumulation means coupled to receive said wear amount $\Delta r$ from said unit wear detection means for calculating said total wear amount $\Sigma\Delta r$ by acululating said wear amount for each truing operation supplied thereto after each truing operation.

11. A grinding machine as recited in claim 10, wherein said unit wear detection means comprises:

touch sensing means disposed in a juxtaposed relation to said truing tool for bodily movement together therewith to and from said grinding wheel and adapted to output a touch sensing signal when brought into contact with said grinding wheel; and unit wear amount calculation means coupled to receive said touch sensing signal from said touch sensing means for calculating said wear amount $\Delta r$ for each truing operation from the difference between said predetermined truing in-feed amount and an inspection feed amount, said inspection feed amount being the amount through which said touch sensing means is fed in an inspection operation after any truing operation from an in-feed starting point until said touch sensing means outputs said touch sensing signal, said in-feed starting point being the point at which a tip of said touch sensing means and a truing surface of said truing tool are aligned with a grinding surface of said grinding wheel in advance of each truing operation and from which said truing tool is in-fed said predetermined truing in-feed amount against said grinding wheel in each truing operation.

12. A grinding machine as recited in claim 11, wherein said touch sensing means comprises:

a touch bar movable together with said truing tool to and from said grinding wheel; and vibration detector means fixed on said touch bar for generating said touch sensing signal when said touch bar is brought into contact with said grinding wheel.

13. A grinding machine comprising:

a bed;

work support means mounted on said bed for rotatably supporting a workpiece to be ground;

a wheel support slidably mounted on said bed for rotabably carrying a grinding wheel made of cubic boron nitride;

a traverse carriage slidable in a direction parallel to the axis of said grinding wheel;

traverse feed means for moving said traverse carriage;

a truing head slidably mounted on said traverse carriage so as to be moved toward and away from the grinding surface of said grinding wheel;

a truing wheel rotatably carried on said truing head;

a detection member mounted on said truing head in a spaced relationship to said truing wheel in an axial direction of said truing wheel by a predetermined distance which is longer than the width of said grinding wheel and movable toward said grinding wheel;

means for detecting the contact between said detection member and said grinding wheel;

feed means for feeding said truing head toward said grinding wheel until said contact detecting means detects the contact between said detection member and said grinding wheel;

said traverse feed means being operable to move said traverse carriage in one direction in response to the detection of the contact between said detection member and said grinding wheel by said contact detecting means so as to locate said grinding wheel between said detection member and said truing wheel;

said feed means being operable to feed said truing head toward and past said grinding wheel by a first predetermined distance for truing said grinding wheel after said grinding wheel is located between said detection member and said truing wheel;

said traverse feed means being operable to move said traverse carriage in said one direction to perform a truing operation on said grinding wheel by said truing wheel after said truing head is fed toward and past said grinding wheel by the first predetermined distance;

said feed means being operable to feed said truing head away from said grinding wheel by the first predetermined distance after said grinding wheel is trued by said truing wheel;

said traverse feed means being operable to move said traverse carriage in the other direction so as to align said detection member with one axial end of said grinding wheel after said truing head is fed away from said grinding wheel by the first predetermined distance;

said feed means being operable to feed said truing head toward said grinding wheel after said detection member is aligned with the one end of said grinding wheel, said contact detecting means being actuated to detect the contact between said detection member and said grinding wheel during feed movement of said truing head toward said grinding wheel, and said detection member being ground by said grinding wheel by an amount corresponding to a wear amount for each truing operation of said truing tool after the detection of the contact between said detection member and said grinding wheel by said contact detecting means;

truing tool wear detection means for detecting a total wear amount of said truing tool based upon the wear amount for each truing operation after each truing operation; and arithmetic and judgement means coupled to said truing tool wear detection means for judging whether or not said grinding wheel has been worn down to a predetermined size limit based upon at least said total wear amount of said truing tool.

* * * * *